US007854138B2

(12) United States Patent
Hwang et al.

(10) Patent No.: US 7,854,138 B2
(45) Date of Patent: Dec. 21, 2010

(54) METHOD FOR CONTROLLING MULTI-UNIT AIR CONDITIONING SYSTEM

(75) Inventors: Il Nahm Hwang, Yongin-si (KR); Sung Oh Choi, Anyang-si (KR); Ho Jong Jeong, Seoul (KR); Seok Ho Yoon, Yongin-si (KR); Jin Ha Choi, Anyang-si (KR)

(73) Assignee: LG Electronics Inc., Seoul (KR)

( * ) Notice: Subject to any disclaimer, the term of this patent is extended or adjusted under 35 U.S.C. 154(b) by 1078 days.

(21) Appl. No.: 11/285,360

(22) Filed: Nov. 23, 2005

(65) Prior Publication Data

US 2006/0117777 A1 Jun. 8, 2006

(30) Foreign Application Priority Data

Dec. 2, 2004 (KR) ..... 10-2004-0100507

(51) Int. Cl.
*F25B 1/00* (2006.01)
*F25B 7/00* (2006.01)
*F25B 1/10* (2006.01)

(52) U.S. Cl. ..... 62/228.5; 62/175; 62/228.1; 62/510; 62/226

(58) Field of Classification Search ..... 62/175, 62/228.5, 510, 228.1, 226; 417/7
See application file for complete search history.

(56) References Cited

U.S. PATENT DOCUMENTS 3,744,932 A * 7/1973 Prevett ..... 417/8
4,341,983 A * 7/1982 Gottliebson ..... 318/102
4,580,947 A 4/1986 Shibata et al.
4,951,475 A * 8/1990 Alsenz ..... 62/117
5,123,256 A * 6/1992 Oltman ..... 62/175
5,231,846 A * 8/1993 Goshaw et al. ..... 62/175
5,467,604 A * 11/1995 Sekigami et al. ..... 62/117
2004/0098994 A1 * 5/2004 Lee ..... 62/175
2005/0262860 A1 * 12/2005 Hwang et al. ..... 62/228.5

FOREIGN PATENT DOCUMENTS

DE 2758153 A1 7/1979
DE 2850589 A1 6/1980
DE 3543707 A1 6/1987
GB 2209193 A 5/1989
JP 05-010607 A 1/1993
JP 10-220896 A 8/1998
JP 10-281577 A 10/1998
JP 2001-041528 A 2/2001
JP 2002-206812 A 7/2002
KR 10-2004-0091357 10/2004

* cited by examiner

*Primary Examiner*—Frantz F Jules
*Assistant Examiner*—Travis Ruby
(74) *Attorney, Agent, or Firm*—Birch, Stewart, Kolasch & Birch, LLP

(57) ABSTRACT

A method for controlling a multi-unit air conditioning system adapted to cool or heat room spaces while passing a refrigerant in one direction or in a reverse direction is disclosed. In the method, which is applied to a multi-unit air conditioning system including at least three compressors, when a compressor re-operation is repeatedly carried out after all of the compressors have been turned off, to turn on again at least one of the compressors, repetition of the compressor re-operation is carried out for a predetermined number of different orders in such a manner that at least one of the compressors is turned on first in an associated order of the repeated compressor re-operation.

12 Claims, 2 Drawing Sheets

METHOD FOR CONTROLLING MULTI-UNIT AIR CONDITIONING SYSTEM

This application claims benefit of Korean Patent Application 10-2004-0100507, filed on Dec. 2, 2004, which is hereby incorporated by reference as if fully set forth herein.

BACKGROUND OF THE INVENTION

1. Field of the Invention

The present invention relates to an air conditioning system, and more particularly, to a method for controlling a multi-unit air conditioning system, wherein the operating times of compressors are uniformly controlled to lengthen the lifespan of the air conditioning system.

2. Discussion of the Related Art

Generally, air conditioning systems perform procedures of compressing, condensing, expanding and evaporating a refrigerant to cool and/or heat a confined space.

Such air conditioning systems are classified into a cooling type wherein a refrigerant flows only in one direction through a refrigerant cycle, to supply cold air to a confined space, and a cooling and heating type wherein a refrigerant flows bi-directionally in a selective manner through a refrigerant cycle, to selectively supply cold air or hot air to a confined space.

Also, such air conditioning systems are classified into a general type wherein one indoor unit is connected to one outdoor unit, and a multi-unit type wherein a plurality of indoor units are connected to one outdoor unit.

One or more compressors are installed in the outdoor unit of such a multi-unit air conditioning system.

In a multi-unit air conditioning system wherein a plurality of compressors are installed, the number of compressors is adjusted in accordance with the amount of refrigerant required in the system.

For example, where the number of indoor units to operate is small, the number of compressors to operate is reduced, whereas if the number of indoor units to operate is large, the number of compressors to operate is increased.

Also, when the temperatures of all confined spaces, for example, all room spaces, to be air-conditioned, satisfy a predetermined temperature range, all compressors, which are in operation, are turned off.

Meanwhile, when only a part of the room spaces exhibit a temperature satisfying the predetermined temperature range, only a part of the compressors, namely, the associated compressors, which are in operation, are turned off.

Also, when the room space or room spaces, which have exhibited a temperature satisfying the predetermined temperature range, subsequently do not satisfy the predetermined temperature range, the associated compressor or compressors are operated again.

However, the above-mentioned conventional multi-unit air conditioning system has the following problems.

First, in the conventional multi-unit air conditioning system, when a part or all of the compressors are turned on again after being turned off, the turning-on of those compressors is controlled to be sequentially carried out, starting from a particular one of the compressors.

For this reason, there is a problem in that the particular compressor, which is always turned on first, is reduced in lifespan, as compared to the remaining compressors.

Second, the operating time of the particular compressor, which is always turned on first, is much longer than those of the remaining compressors. For this reason, there is a problem in that, if the lifespan of the particular compressor is substantially exhausted, the outdoor unit itself or the system itself must be replaced even though the lifespan of the remaining compressors is sufficient.

This is because the system cannot generally operate with a sufficient performance under the condition in which the lifespan of even one compressor is substantially exhausted, and it is necessary to replace the outdoor unit itself or the system itself unless the cause of the degradation in system efficiency can be found.

Third, since the lifespans of the compressors are non-uniform, the performances of the indoor units are non-uniform. For this reason, the time taken for the process of repairing the system and the number of times to perform the repairing process are increased.

As a result, the maintenance and repair costs of the system increases. Furthermore, a remarkable degradation in the reliability of the system occurs.

Fourth, since the sequence of turning on the compressors is fixed, there is a problem in that the lifespan difference between the compressor, which is always turned on first, and the compressor, which is always turned on last.

SUMMARY OF THE INVENTION

Accordingly, the present invention is directed to a method for controlling a multi-unit air conditioning system that substantially obviates one or more problems due to limitations and disadvantages of the related art.

An object of the present invention is to provide a method for controlling a multi-unit air conditioning system, which is capable of uniformly controlling the operating time of a compressor, thereby lengthening the lifespan of the air conditioning system.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for controlling a multi-unit air conditioning system including at least three compressors is provided, wherein, when a compressor re-operation is repeatedly carried out after all of the compressors have been turned off, to turn on again at least one of the compressors, the repetition of the compressor re-operation is carried out for a predetermined number of different orders in such a manner that at least one of the compressors is turned on first in an associated order of the repeated compressor re-operation.

All of the compressors may be sequentially turned on first one by one.

After a predetermined one of the compressors is turned on, the remaining compressors may be sequentially turned on one by one.

The sequence of turning on the remaining compressors may be set such that the compressor turning-on sequences in the different compressor re-operation orders, the compressor turned-on firsts of which are different from one another, are different from one another.

When at least two of the turned-on compressors are to be turned off, a more lengthily operated one of the turned-on compressors may be preferentially turned off.

In another aspect of the present invention, a method for controlling a multi-unit air conditioning system including at least three compressors is provided, wherein, when at least two of the compressors are to be turned off from a turned-on state, a more lengthily operated one of the turned-on compressors is preferentially turned off.

In another aspect of the present invention, a method for controlling a multi-unit air conditioning system including at least two outdoor units, a main compressor unit including at least one compressor installed in one of the outdoor units, and one or more sub compressor units each including one or more compressors installed in the remaining one or ones of the outdoor units is provided, wherein, when a compressor re-operation is repeatedly carried out after all of the compressors have been turned off, to turn on again at least one of the compressors, the repetition of the compressor re-operation is carried out for a predetermined number of different orders in such a manner that at least one of the compressors is turned on first in an associated order of the repeated compressor re-operation.

All of the compressors in the sub compressor units may be sequentially turned on first one by one.

After a predetermined one of the compressors is turned on, the remaining compressors may be sequentially turned on one by one.

The sequence of turning on the remaining compressors may be set such that the compressor turning-on sequences in the different compressor re-operation orders, the compressor turned-on firsts of which are different from one another, are different from one another.

When at least two of the turned-on compressors are to be turned off, a more lengthily operated one of the turned-on compressors in the sub compressor units may be preferentially turned off.

The compressor of the main compressor unit may be turned on later than the compressors of the sub compressor units, and may be turned off earlier than the compressors of the sub compressor units.

When the number of the turned-on compressors in the sub compressor units is gradually increased, the number of turned-on compressors in each sub compressor unit may be equal to the number of turned-on compressors in each of the remaining sub compressor units.

In another aspect of the present invention, a method for controlling a multi-unit air conditioning system including at least two outdoor units, a main compressor unit including at least one compressor installed in one of the outdoor units, and one or more sub compressor units each including one or more compressors installed in the remaining one or ones of the outdoor units is provided, wherein, when at least two of the compressors are to be turned off from a turned-on state, a more lengthily operated one of the turned-on compressors in the sub compressor units is preferentially turned off.

The compressor of the main compressor unit may be turned on later than the compressors of the sub compressor units, and may be turned off earlier than the compressors of the sub compressor units.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

First, a method for controlling a multi-unit air conditioning system in accordance with a first embodiment of the present invention will be described with reference to FIG. 1.

Before describing the first embodiment, the configuration of the multi-unit air conditioning system, to which the first embodiment is applied, will be described with reference to FIG. 1.

In the multi-unit air conditioning system, a plurality of indoor units are connected to an outdoor unit.

The outdoor unit includes at least three compressors.

In the multi-unit air conditioning system having such a configuration, the number of the compressors may be varied depending on a required compressor capacity. Accordingly, the following description will be given in conjunction with an example in which seven compressors are installed in the outdoor unit.

Each of the seven compressors is a constant-speed compressor having a constant operating frequency. Each compressor forms one compressing unit.

Figure 1:
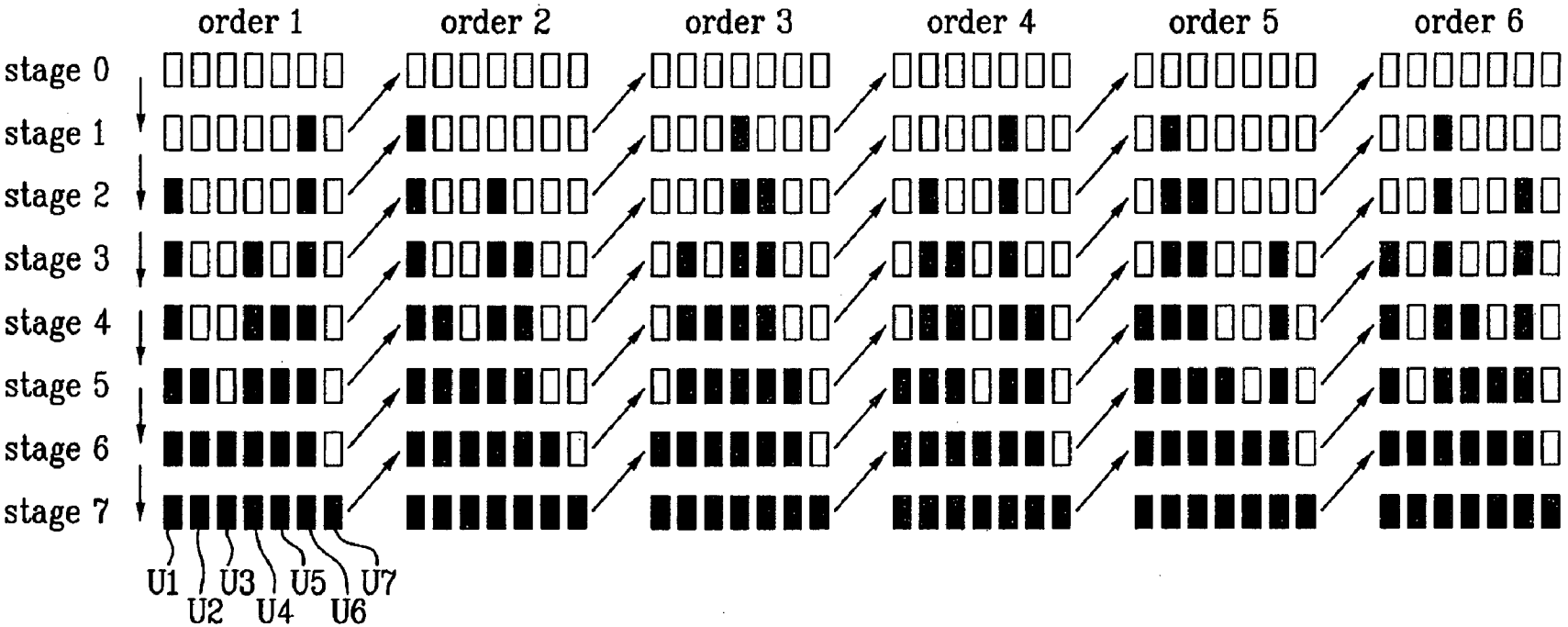
FIG. 1 is a table illustrating a method for controlling a multi-unit air conditioning system according to a first embodiment of the present invention.

FIG. 1 is a table illustrating the sequence of turning on the seven compressors after turning off the compressors.

In the table, each rectangular block represents one compressor.

Also, each empty or white rectangular block represents a turned-off compressor, and each black rectangular block represents a turned-on compressor.

In the table, six matrices each including 7×8 blocks of 7 columns and 8 rows are arranged.

Each matrix of 7 columns and 8 rows is referred to as an "order", and each row in each order is referred to as a "stage".

Each stage in each order represents ON/OFF stages of the seven compressors, and the number of each stage represents the number of the turned-on compressors.

Referring to the table, it can be seen that the number of the turned-on compressors increases gradually from the uppermost stage to the lowermost stage.

In the following description, the compressors are referred to as first through seventh compressors in the sequence from the left to the right in each stage.

Now, the first embodiment will be described in detail.

In a multi-unit air conditioning system including at least three compressors, for example, seven compressors U1 to U7 in the illustrated case, compressor re-operation is repeatedly carried out in which, after all of the compressors U1 to U7 are turned off, at least one of the compressors U1 to U7 is turned on again. Repetition of the compressor re-operation is carried out in such a manner that at least one of the compressors U1 to U7 is turned on first in an associated order of the repeated compressor re-operation.

In this case, it is preferred that one of the compressors U1 to U7 be turned on first in an associated order of the repeated compressor re-operation.

The compressor turned-on first is designated by a black block in Stage 1 in an associated compressor re-operation order in the table.

For example, as shown in the table, the sixth compressor U6 is turned on first in Order 1, the first compressor U1 in Order 2, the second compressor U4 in Order 3, the fifth compressor U5 in Order 4, the second compressor U2 in Order 5, and the third compressor U3 in Order 6.

Although one of the seven compressors U1 to U7, which is turned-on first, operates for the longest time, it is possible to equalize the operating times of all compressors U1 to U7 by first turning on one of the compressors U1 to U7 in an associated order of the repeated compressor re-operation.

Of course, it will be appreciated that two of the compressors U1 to U7 may be turned on first in an associated order of the repeated compressor re-operation. Even three of the compressors U1 to U7 may be turned on first in an associated order of the repeated compressor re-operation.

However, it is most preferable to turn on first one of the compressors U1 to U7 in an associated order of the repeated compressor re-operation, in terms of a reduction in the compressor load in an initial stage of compressor re-operation.

It is also preferred that, after a desired one of the compressors U1 to U7 is turned on first, the remaining compressors be turned on one by one.

For example, the compressors U1 to U7 are turned on one by one in accordance with an increase in the stage number in each order of the repeated compressor re-operation, as in a vertical arrow direction in the table.

That is, the compressors U1 to U7 are turned on one by one as compressor re-operation proceeds from Stage 0 to Stage 7.

When all indoor units are to operate, all compressors U1 to U7 are sequentially turned on in a stage sequence in an associated compressor re-operation order.

Also, when a fraction of the indoor units are to operate, associated ones of the compressors U1 to U7 are sequentially turned on in accordance with compressor re-operation proceeding to an associated stage in the associated compressor re-operation order.

For example, when four compressors are to be turned on, compressor re-operation proceeds to Stage 4 of the associated re-operation order.

In this case, it is more preferable to set the sequence of turning on the compressors such that the compressor turning-on sequences in different compressor re-operation orders, the compressor turned-on firsts of which are different from one another, are different from one another.

For example, where the compressor turned-on first is the sixth compressor U6, as in Order 1, the remaining compressors are sequentially turned on in a sequence of the first compressor U1, the fourth compressor U4, the fifth compressor U5, the second compressor U2, the third compressor U3, and the seventh compressor U7.

Also, where the compressor turned-on first is the first compressor U1, as in Order 2, the remaining compressors are sequentially turned on in a sequence of the fourth compressor U4, the fifth compressor U5, the second compressor U2, the third compressor U3, the sixth compressor U6, and the seventh compressor U7. Thus, the compressor turning-on sequences in Orders 1 and 2, the compressor turned-on firsts of which are different from each other, are different from each other.

Similarly, in the remaining Orders, the compressor turned-on firsts thereof are different from one another, and the compressor turning-on sequences thereof are different from one another.

Where it is necessary to turn off at least two of the turned-on compressors, it is preferred that a more lengthily operated one of the compressors to be turned off be preferentially turned off.

For example, where it is necessary to turn off one of the compressors operating in Stage 4 of Order 1, the sixth compressor U6, which has operated for the longest operating time in Order 1, is preferentially turned off. That is, the system status transits to Stage 3 of Order 2 (in a diagonal arrow direction) in this case.

When it is subsequently necessary to additionally turn off one compressor, the first compressor U1, which has operated for the second longest operating time in Order 1, is turned off. That is, the system status transits to Stage 2 of Order 3 (in a diagonal arrow direction).

Thus, when it is necessary to turn off all of the turned-on compressors, the compressor turning-off is carried out while sequentially performing a stage transition wherein the current stage of the current compressor re-operation order is transited to another stage belonging to the compressor re-operation order neighboring the current compressor re-operation order in a higher-level direction, and having a level lower than that of the current stage by one level.

Hereinafter, operation of the above-described first embodiment will be described.

For example, where compressor re-operation is carried out to turn on three compressors under the condition in which all compressors have been turned off, the system status is first transited from Stage 0 of Order 1 to Stage 1 of the same Order.

In this case, the sixth compressor U6 is turned on first.

Thereafter, the system status is transited to Stage 2 of Order 1, and is then transited to Stage 3 of Order 1.

Accordingly, the first compressor U1 and fourth compressor U4 are sequentially turned on.

In this case, it is preferred that the stage transition be carried out after the compressor turned on before the stage transition reaches a normal frequency, in order to reduce the load of the compressor in an initial stage of a start-up operation of the compressor.

When the temperatures of the room spaces, to be air-conditioned, satisfy a predetermined temperature range after turning-on the three compressors, the sixth compressor U6, which has operated for the longest time, is preferentially turned off. That is, the system status is transited from Stage 3 of Order 1 to Stage 2 of Order 2.

Next, the first compressor U1, which has operated for the second longest time, is turned off. That is, the system status is transited from Stage 2 of Order 2 to Stage 1 of Order 3.

Then, the fourth compressor U4 is also turned off.

On the other hand, it may be necessary to turn on an additional compressor in Stage 2 of Order 2. In this case, the system status is transited from Stage 2 of Order 2 to Stage 2 of the same Order to turn on the second compressor U2.

When it is necessary to again perform compressor re-operation to turn on three compressors after all compressors have been turned off, as described above, the system status is transited to Stage 1 of Order 4 to turn on the fifth compressor U5.

Operations of turning on and off the compressors in other system status transition procedures are substantially identical to those of the above-described procedures, so that no description thereof will be given.

Hereinafter, a method for controlling a multi-unit air conditioning system in accordance with a second embodiment of the present invention will be described with reference to FIG. 2.

The multi-unit air conditioning system, to which the second embodiment is applied, includes at least two outdoor units, for example, four outdoor units in the illustrated case, a main compressor unit U4 installed in one of the outdoor units, and sub compressor units U1 to U3 respectively installed in the remaining outdoor units.

The main compressor unit U4 includes at least one compressors, whereas each of the sub compressor units U1 to U3 includes at least two compressors.

In the above-described multi-unit air conditioning system, the number of compressors in each of the sub compressor units U1 to U3 and the number of compressors in the main compressor unit U4 may be diversely adjusted in accordance with the capacity of the system. For simplicity, accordingly, the following description will be given in conjunction with an example in which the system includes three sub compressor units each including two compressors, and one main compressor unit including one compressor.

Each compressor of the sub compressor units is a constant-speed compressor having a constant operating frequency, whereas the compressor of the main compressor unit is an inverter compressor. Of course, all compressors of the main and sub compressor units may be constant-speed compressors.

Figure 2:
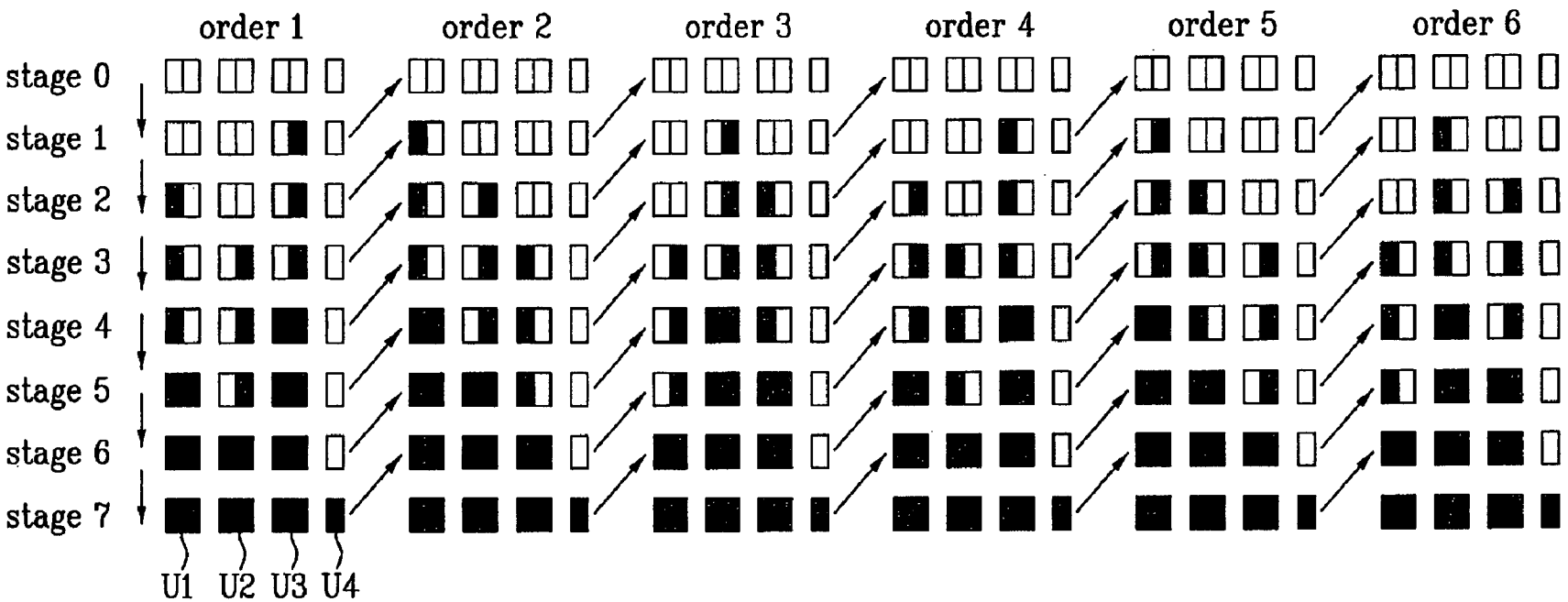
FIG. 2 is a table illustrating a method for controlling a multi-unit air conditioning system according to a second embodiment of the present invention.

FIG. 2 is a table illustrating the sequence of turning on the compressors of the main compressor unit U4 and sub compressor units U1 to U3 after turning off the compressors.

Definition of Orders and Stages in the table of FIG. 2 is identical to that of the first embodiment, so that no description thereof will be given.

Provided, the second embodiment is different from the first embodiment in that the compressors are grouped into the sub compressor units U1 to U3 and the main compressor unit U4, and each of the sub compressor units U1 to U3 includes two compressors.

The second embodiment will now be described in detail.

In a multi-unit air conditioning system including a plurality of sub compressor units, for example, three sub compressor units U1 to U3 in the illustrated case, each including at least one compressor, and one main compressor unit, for example, one main compressor unit U4 in the illustrated case, compressor re-operation is repeatedly carried out in which, after all compressors are turned off, at least one of the compressors is turned on again. Repetition of the compressor re-operation is carried out in such a manner that at least one of the compressors included in the sub compressor units U1 to U3 is turned on first in an associated order of the repeated compressor re-operation.

In this case, it is preferred that one of the compressors included in the sub compressor units U1 to U3 be turned on first in an associated order of the repeated compressor re-operation.

The compressor turned-on first is designated by a black block in Stage 1 in an associated compressor re-operation order in the table of FIG. 2.

For example, as shown in the table of FIG. 2, the sixth compressor is turned on first in Order 1, the first compressor in order 2, the second compressor in Order 3, the fifth compressor in Order 4, the second compressor in Order 5, and the third compressor in Order 6.

Accordingly, it is possible to equalize the operating times of all compressors.

Of course, it will be appreciated that all compressors included in each sub compressor unit, namely, two compressors in the illustrated case, may be turned on first in an associated order of the repeated compressor re-operation.

However, it is most preferable to turn on first one of the compressors in an associated order of the repeated compressor re-operation, in terms of a reduction in the compressor load in an initial stage of compressor re-operation.

It is also preferred that, after the first turning-on of a desired one of the compressors included in the sub compressor units U1 to U3, the remaining compressors be turned on one by one.

For example, the compressors are turned on one by one in accordance with an increase in the stage number in each order of the repeated compressor re-operation, as in a vertical arrow direction in the table of FIG. 2.

When all indoor units are to operate, all compressors are sequentially turned on in a stage sequence in an associated compressor re-operation order.

Also, when a fraction of the indoor units are to operate, associated ones of the compressors are sequentially turned on in accordance with compressor re-operation proceeding to an associated stage in the associated compressor re-operation order.

In this case, it is more preferable to set the sequence of turning on the compressors included in the sub compressor units U1 to U3 such that the compressor turning-on sequences in different compressor re-operation orders, the compressor turned-on firsts of which are different from one another, are different from one another.

For example, where the compressor turned-on first is the sixth compressor, as in Order 1, the remaining compressors are sequentially turned on in a sequence of the first compressor, the fourth compressor, the fifth compressor, the second compressor, the third compressor, and the seventh compressor.

Where it is necessary to turn off at least two of the turned-on compressors, it is preferred that a more lengthily operated one of the compressors to be turned off be preferentially turned off.

For example, where it is necessary to turn off one of the compressors operating in Stage 4 of Order 1, the sixth compressor, which has operated for the longest operating time in Order 1, is preferentially turned off. That is, the system status transits to Stage 3 of Order 2 (in a diagonal arrow direction) in this case.

When it is subsequently necessary to additionally turn off one compressor, the first compressor, which has operated for the second longest operating time in Order 1, is turned off. That is, the system status transits to Stage 2 of Order 3 (in a diagonal arrow direction).

Thus, when it is necessary to turn off all of the turned-on compressors, the compressor turning-off is carried out while sequentially performing a stage transition wherein the current stage of the current compressor re-operation order is transited to another stage belonging to the compressor re-operation order neighboring the current compressor re-operation order in a higher-level direction, and having a level lower than that of the current stage by one level.

It is also preferred that the compressor of the main compressor unit U4 be turned on later than the compressors of the sub compressor units U1 to U3, and be turned off earlier than the compressors of the sub compressor units U1 to U3.

Also, it is preferred that, when the number of turned-on compressors in the sub compressor units U1 to U3 is gradually increased, the number of turned-on compressors in each sub compressor unit be equal to those of the remaining sub compressor unit.

Referring to, for example, Stages 3 of Orders 1 to 6, one compressor is turned on in each of the three sub compressor units U1 to U3.

Thus, first ones of the compressors in the sub compressor units U1 to U3 are sequentially turned on one by one, and the remaining compressors in the sub compressor units U1 to U3 are then sequentially turned on one by one.

Accordingly, it is possible to equalize the compressor operating times of the sub compressor units U1 to U3.

The operation of the second embodiment is substantially identical to that of the first embodiment, so that no description thereof will be given.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling a multi-unit air conditioning system, comprising:

providing n compressors, wherein n is a number greater than 2; and providing n orders for operating all of the compressors, each order having a sequence for turning on all of the compressors one by one and each order starting the sequence with a different compressor, wherein the sequence of one order is carried out in such a manner that at least one of the compressors is turned on first in an associated order, wherein, after a predetermined one of the compressors in the associated order is turned on, the remaining compressors are sequentially turned on one by one, wherein when a compressor re-operation is repeatedly carried out after all of the compressors have been turned off, the repetition of the compressor re-operation is carried out by the sequence of another order, and wherein the sequence of turning on the remaining compressors is set such that sequences of different orders are different from one another.

2. The method according to claim 1, wherein, when at least two of the turned-on compressors are to be turned off, a more lengthily operated one of the turned-on compressors is turned off.

3. A method for controlling a multi-unit air conditioning system including at least two outdoor units, comprising:

providing a main compressor unit including at least one compressor installed in one of the outdoor units, and one or more sub-compressor units each including one or more compressors installed in the remaining one or ones of the outdoor units;

providing a sequence for operating the compressors; and providing a number of orders for operating the compressors, each order following the sequence for operating the compressors and each order starting the sequence with a different compressor, the number of orders being equal to the number of compressors, wherein, when a compressor re-operation is repeatedly carried out after all of the compressors have been turned off, the repetition of the compressor re-operation is carried out by one of the number of different orders, wherein the compressor of the main compressor unit is an inverter compressor, each compressor of the sub-compressor units is a constant-speed compressor having a constant operating frequency, and wherein the compressor of the main compressor unit is turned on later than the compressors of the sub-compressor units, and is turned off earlier than the compressors of the sub-compressor units.

4. The method according to claim 3, wherein all of the compressors in the sub compressor units are sequentially turned on first one by one.

5. The method according to claim 4, wherein, after a predetermined one of the compressors is turned on, the remaining compressors are sequentially turned on one by one.

6. The method according to claim 4, wherein, when at least two of the turned-on compressors are to be turned off, a more lengthily operated one of the turned-on compressors in the sub compressor units is turned off.

7. The method according to claim 4, wherein, when the number of the turned-on compressors in the sub compressor units is gradually increased, the number of turned-on compressors in each sub compressor unit is equal to the number of turned-on compressors in each of the remaining sub compressor units.

8. The method according to claim 5, wherein the sequence of turning on the remaining compressors is set such that the compressor turning-on sequences in the different compressor re-operation orders, the compressor turned-on first of which are different from one another, are different from one another.

9. The method according to claim 5, wherein, when at least two of the turned-on compressors are to be turned off, a more lengthily operated one of the turned-on compressors in the sub compressor units is turned off.

10. The method according to claim 5, wherein, when the number of the turned-on compressors in the sub compressor units is gradually increased, the number of turned-on compressors in each sub compressor unit is equal to the number of turned-on compressors in each of the remaining sub compressor units.

11. The method according to claim 8, wherein, when at least two of the turned-on compressors are to be turned off, a more lengthily operated one of the turned-on compressors in the sub compressor units is turned off.

12. The method according to claim 8, wherein, when the number of the turned-on compressors in the sub compressor units is gradually increased, the number of turned-on compressors in each sub compressor unit is equal to the number of turned-on compressors in each of the remaining sub compressor units.

* * * * *